US009506712B2

(12) United States Patent
Mather et al.

(10) Patent No.: US 9,506,712 B2
(45) Date of Patent: Nov. 29, 2016

(54) FIREARM WITH TUBULAR HANDGUARD MOUNTING SYSTEM

(71) Applicant: Sturm, Ruger & Company, Inc., Southport, CT (US)

(72) Inventors: Jonathan Philip Mather, Grafton, NH (US); David B. Kangas, Claremont, NH (US)

(73) Assignee: STURM, RUGER & COMPANY, INC.

( * ) Notice: Subject to any disclaimer, the term of this patent is extended or adjusted under 35 U.S.C. 154(b) by 0 days.

(21) Appl. No.: 14/925,020

(22) Filed: Oct. 28, 2015

(65) Prior Publication Data

US 2016/0116251 A1 Apr. 28, 2016

Related U.S. Application Data

(60) Provisional application No. 62/069,727, filed on Oct. 28, 2014.

(51) Int. Cl.
*F41C 23/16* (2006.01)
*F41A 21/48* (2006.01)

(52) U.S. Cl.
CPC ..... *F41A 21/482* (2013.01)

(58) Field of Classification Search
CPC ..... F41C 23/16; F41A 21/48; F41A 21/481; F41A 21/482; F41A 21/487
USPC ..... 42/71.01, 72, 73, 74, 75.01, 75.02
See application file for complete search history.

(56) References Cited

U.S. PATENT DOCUMENTS

| | | | | |
|---|---|---|---|---|
| 2,736,118 | A * | 2/1956 | Clarkson | F41A 21/12 42/75.02 |
| 3,027,672 | A * | 4/1962 | Sullivan | F41A 21/12 42/16 |
| 3,877,167 | A * | 4/1975 | Keppeler | F41A 21/482 42/75.02 |
| 4,152,855 | A | 5/1979 | Dubiel et al. | |
| 5,412,895 | A * | 5/1995 | Krieger | F41A 21/482 42/75.02 |
| 6,591,534 | B1 * | 7/2003 | Trudeau | F41A 21/482 42/75.02 |
| 7,523,580 | B1 | 4/2009 | Tankersley | |
| 7,905,041 | B1 | 3/2011 | Davies | |
| 2010/0319231 | A1 | 12/2010 | Stone et al. | |

(Continued)

OTHER PUBLICATIONS

Corresponding International Search Report and Written Opinion for PCT/US15/57732 dated Jan. 14, 2016.

*Primary Examiner* — Bret Hayes
(74) *Attorney, Agent, or Firm* — The Belles Group, P.C.

(57) ABSTRACT

A firearm with tubular handguard mounting system is provided. The firearm includes receiver, a barrel having a breech threadably engaging the receiver, and a handguard. A primary barrel nut threadably engages the breech end of the barrel and is moveable into abutting contact with the receiver to form a tightened barrel to receiver connection. A secondary barrel nut threadably engages the primary barrel nut and is tightened thereto to trap an external annular barrel flange between the primary barrel nut and an annular abutment surface on the secondary barrel nut. The secondary barrel nut provides a free float tubular handguard, such as an AR-15 type handguard. Additionally, the primary barrel nut and secondary barrel nut provide a dual locking feature which resists loosening of the barrel connection.

22 Claims, 20 Drawing Sheets

(56) References Cited

U.S. PATENT DOCUMENTS

2011/0126443 A1* 6/2011 Sirois ..... F41C 23/16
42/90
2012/0102805 A1 5/2012 Buxton
2012/0311908 A1* 12/2012 Kenney ..... F41A 21/485
42/75.02
2014/0075817 A1 3/2014 Gomez
2014/0115938 A1* 5/2014 Jarboe ..... F41A 21/485
42/71.01
2014/0223794 A1* 8/2014 Brown ..... F41C 23/16
42/75.03
2016/0003570 A1* 1/2016 Tonkin ..... F41A 21/02
89/14.4

* cited by examiner

FIREARM WITH TUBULAR HANDGUARD MOUNTING SYSTEM

CROSS-REFERENCE TO RELATED APPLICATIONS

The present application claims the benefit of priority to U.S. Provisional Application No. 62/069,727 filed Oct. 28, 2014, the entirety of which is incorporated herein by reference.

BACKGROUND

The present invention generally relates to firearms, and more particularly to a handguard attachment or mounting system and related method for screw-in type firearm barrels.

In contrast to semi-automatic firearms such as AR-15 style rifles which have an action (i.e. operating system) that automatically cycles the bolt when the firearm is discharged to eject the spent ammunition shell and chamber a new shell, the bolt in a bolt action rifles must typically be cycled manually using a bolt handle to achieve the same result. Many modern bolt action stock and chassis systems have tubular hand-guards surrounding the barrel. This offers several benefits including flexible mounting options for lights, lasers or night vision devices, protection from unwanted contact with the free floated barrel and improved shielding of the hot barrel to reduce the mirage effect which may interfere with sighting the rifle. The majority of these handguards attaches directly to the chassis or stock, and in some cases are attached to the receiver. In most cases the main stock or chassis is positioned below the receiver, so the transition to the round handguard interface requires additional material or parts adding cost, weight and complexity.

One popular method of securing a "screw-in" threaded barrel to a receiver of the bolt action rifle is with a jam nut threaded onto the barrel that is tightened against the receiver when the barrel is in the correct location (see, e.g. FIG. 1). This effectively holds all of the components in place and allows a tight headspace dimensions to be held without requiring each barrel to be precisely machined to match a particular receiver and bolt. The externally threaded barrel is first threaded into a corresponding threaded bore in the front of the receiver, and then the jam nut is tightened to prevent the barrel to receiver interface from loosening when firing the rifle. This arrangement requires mounting free floating type tubular handguards to the chassis, receiver, or stock which has drawbacks as described above.

The barrel to receiver interface is achieved in a different manner in a semi-automatic AR-15 type rifle which supports mounting a free floating AR-15 type handguard. Such firearms utilize a slide-in type barrel arrangement. The aluminum upper receiver of an AR-15 type rifle has a forward projecting externally threaded portion or nipple that surrounds a plain bore sized to accept the barrel (see, e.g. FIG. 2). There is an external flange on the barrel extension threadably coupled to the rear of the barrel that sits just outside the receiver's externally thread portion that is positioned to contact an internal flange on an AR-15 style barrel nut when it is threaded onto upper receiver. There is a plurality of radially extending castellations on the barrel nut for conveniently clamping the tubular free floating handguard thereto in a simple manner without requiring additional parts or material.

Unlike the bolt action rifle barrel assembly shown in FIG. 1, the AR-15 barrel nut in FIG. 2 is not a jam nut. It secures the barrel assembly to the receiver by just forcing the flange on the barrel extension into contact with the upper receiver. The AR-15 barrel assembly is pre-headspaced so precise positioning during assembly is not required. A pin protruding from the barrel assembly engages the upper receiver to prevent relative rotation. The AR-15 barrel nut usually is applied with a torque between 35 and 80 ft-lbs (foot pounds).

Accordingly, an improved system which allows attachment of a free floating AR-15 type handguard to a bolt action rifle with screw-in barrel is desired.

SUMMARY

A handguard mounting system for a screw-in type bolt action rifle barrel is provided with a unique interface which overcomes the foregoing shortfalls of the traditional manner used to mount free floating tubular handguards to bolt action rifles. By using standard AR-15 type "free floating" handguards and securing them directly to the barrel and barrel nut using the interface disclosed herein, the connection method is greatly simplified, barrel rigidity is improved, and a larger number of handguard options are available to the user of a bolt action rifle.

According to one aspect, a firearm with tubular handguard mounting system includes a receiver; a screw-in type barrel supported by the receiver, the barrel comprising a muzzle end and a breech end threadably engaging a threaded bore in a front end of the receiver; a primary barrel nut threadably engaging the breech end of the barrel, the primary barrel nut abuttingly engaging the front end of the receiver; a secondary barrel nut assembly threadably engaging the primary barrel nut, the secondary barrel nut assembly including an annular abutment surface abuttingly engaging an external annular flange on the barrel, the external annular flange on the barrel compressed against the primary barrel nut by the annular abutment surface on the secondary barrel nut assembly; and a tubular handguard mounted to the secondary barrel nut assembly and encircling at least part of a length of the barrel.

According to another aspect, a firearm with tubular handguard mounting system includes: a receiver having a plurality of bolt locking lugs for forming a locked breech; a screw-in type barrel supported by the receiver, the barrel comprising a front muzzle end and a rear breech end having external threads, a first portion of the external threads threadably engaging a threaded bore in a front end of the receiver, and a second portion of the external threads positioned forward of the receiver; a primary barrel nut threadably engaging the second portion of the external threads of the barrel on the breech end, the primary barrel nut further including external threads; a secondary barrel nut threadably engaging the primary barrel nut, the secondary barrel nut including an internal annular abutment surface abuttingly engaging an external annular flange on the barrel, the external annular flange on the barrel compressed against the primary barrel nut by the annular abutment surface on the secondary barrel nut; a sprocket formed on the primary barrel nut comprising a plurality of radially extending sprocket teeth projecting outwards from the primary barrel nut; and a tubular handguard coupled to the secondary barrel nut assembly and encircling at least part of a length of the barrel.

A method for mounting a tubular handguard on a firearm is provided. The method includes: threading a primary barrel nut onto an externally threaded breech of a barrel defining a chamber for holding a cartridge; screwing the threaded breech end of the barrel into a threaded bore of a receiver;

rotating and tightening the primary barrel nut against the receiver to lock the barrel to the receiver; sliding a secondary barrel nut over the barrel; threading the secondary barrel nut onto the primary barrel nut by engaging internal threads of the secondary barrel nut with external threads on the primary barrel nut; engaging an internal annular flange on the secondary barrel nut with an external annular flange on the barrel; and rotating and tightening the secondary barrel nut to compress the external flange on the barrel against the primary barrel nut.

Further areas of applicability of the present invention will become apparent from the detailed description provided hereinafter.

BRIEF DESCRIPTION OF THE DRAWINGS

The features of the exemplary embodiments will be described with reference to the following drawings where like elements are labeled similarly, and in which:

All drawings are schematic and not necessarily to scale. Parts given a reference numerical designation in one figure may be considered to be the same parts where they appear in other figures without a numerical designation for brevity unless specifically labeled with a different part number and/or described herein. Parts described herein with respect to certain figures may also appear in other figures. Furthermore, a general reference to a whole figure number (e.g. FIG. 10) which may include multiple subparts (e.g. FIGS. 10A, 10B, etc.) shall be construed as a reference to all of the subparts unless specifically noted otherwise.

DETAILED DESCRIPTION

Figure 1:
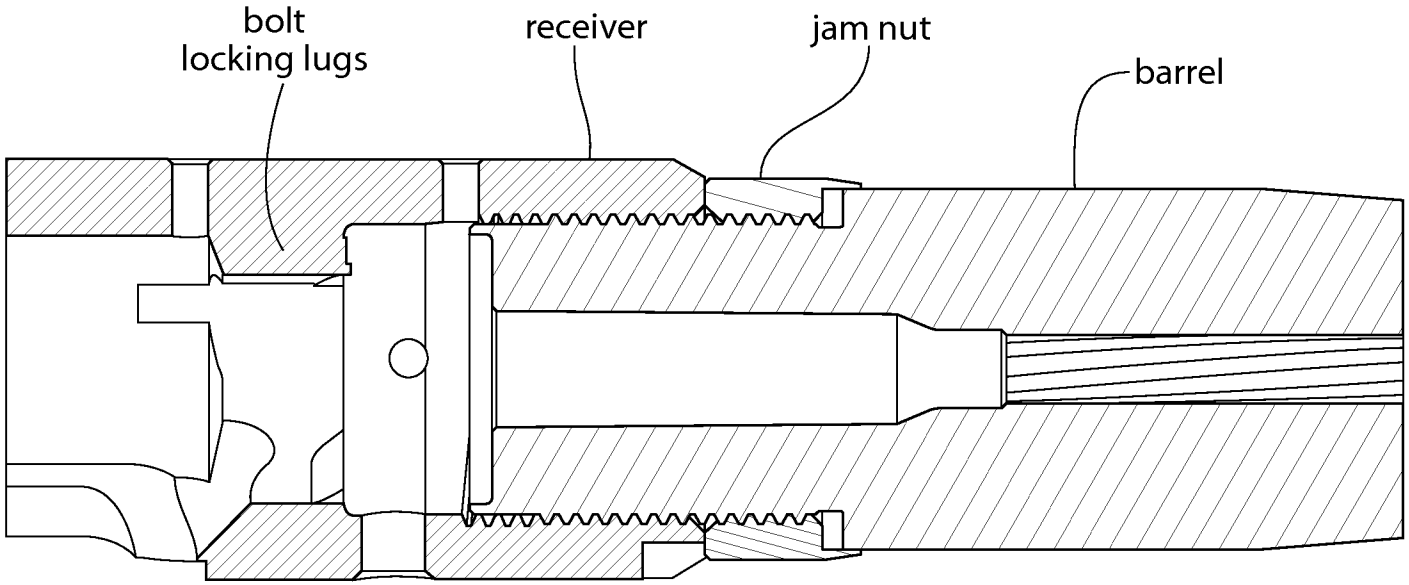
FIG. 1 (PRIOR ART)
FIG. 1 is cross-sectional side view of the breech area of a bolt action rifle with screw-in type barrel.

The features and benefits of the invention are illustrated and described herein by reference to exemplary embodiments. This description of exemplary embodiments is intended to be read in connection with the accompanying drawings, which are to be considered part of the entire written description. Accordingly, the disclosure expressly should not be limited to such exemplary embodiments illustrating some possible non-limiting combination of features that may exist alone or in other combinations of features.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

The term "action" is used herein in its conventional sense in the firearm art as meaning the mechanism that loads and ejects shells into/from the firearm and opens and closes the breech (i.e. the area in the receiver between an openable/closeable breech face on the front of the bolt and the rear face of the barrel chamber).

Figure 4:
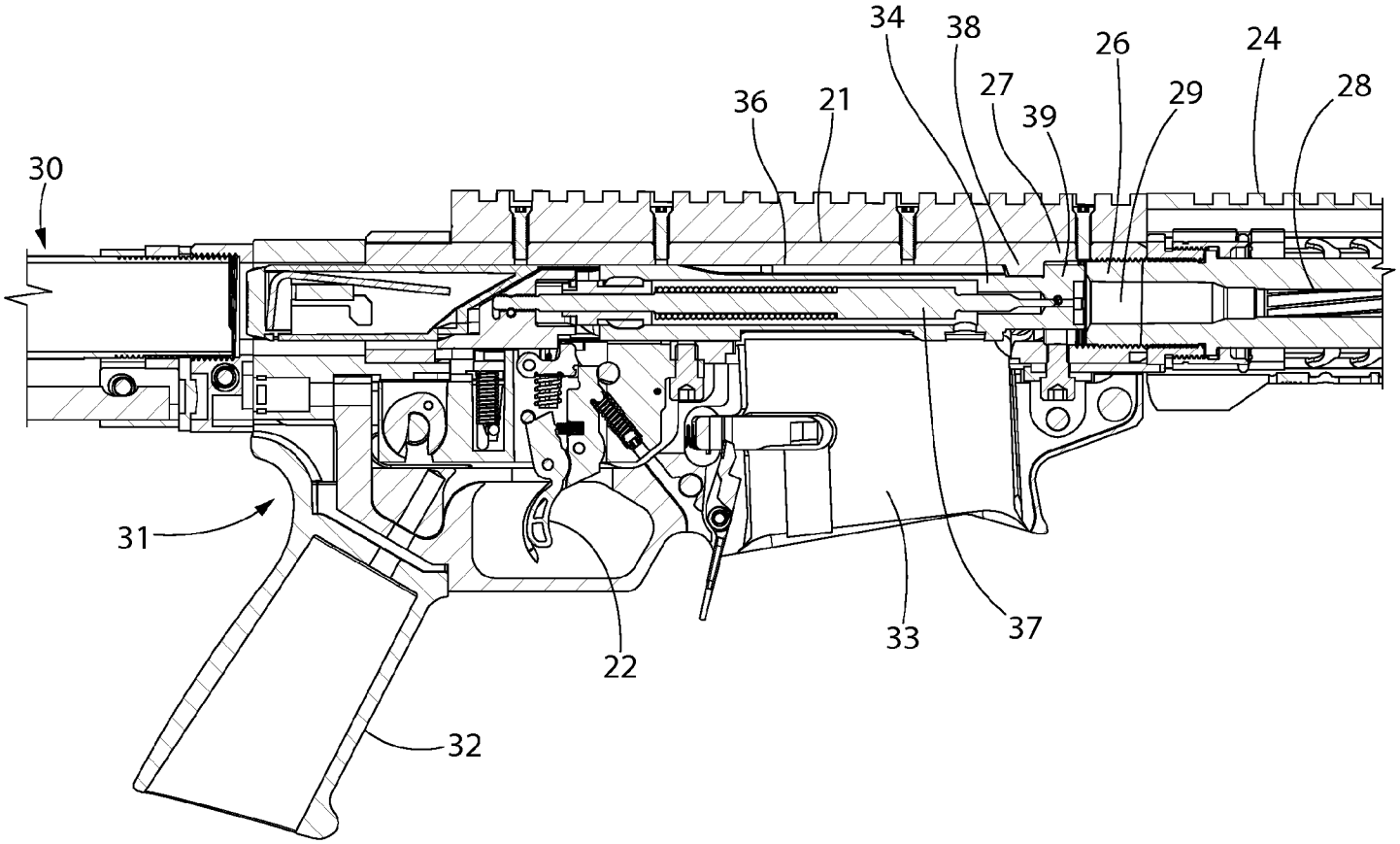
FIG. 4 is a right side partial cross sectional view of the receiver showing the barrel to receiver interface.

FIG. 1 is a longitudinal perspective view of a firearm 20 having a barrel and handguard mounting system according to the present disclosure. Referring to FIGS. 1 and 4, firearm 20 may be a bolt action rifle in this embodiment generally including a receiver 21, a trigger actuated fire control mechanism 22 mounted in a longitudinally extending chassis 31 and operable to discharge the firearm, a barrel 23 supported by the receiver, and a handguard 24 enclosing and circumscribing at least part of the length of the barrel. The receiver 21 may be mounted in the chassis 31, which includes various appurtenances including for example without limitation a pistol grip 32, magazine well 33 for removably inserting magazines containing ammunition cartridges, etc. A buttstock 30 extends rearward from and is mounted to the receiver 21 for placement against the user's shoulder when aiming and firing the firearm 20. Buttstock 30 may be any type or configuration of buttstock including adjustable and non-adjustable varieties.

The barrel 23 includes an open front muzzle end 25, an open rear breech end 26, and longitudinally extending bore 28 formed between the ends of the barrel which defines a projectile pathway. An enlarged cartridge chamber 29 is formed at the rear breech end 26 which is configured for holding an ammunition cartridge. The firearm 20 has a longitudinal axis LA and corresponding axial direction coinciding with the centerline of the barrel 23 and its longitudinal bore for reference purposes.

Receiver 21 houses an axially movable bolt 34 which may include a bolt handle 35 for manually forming a closed or open breech in a manner well known in bolt action rifles. The bolt 34 is slidably disposed for forward/rearward movement in an axially extending internal cavity 36 of the receiver. Bolt 34 in turn includes an axially movable spring-loaded firing pin 37 which may be projected forward for a short distance from the front face of the bolt by the fire control mechanism 22 for detonating a chambered ammunition cartridge positioned in the barrel chamber 29.

Figure 2:
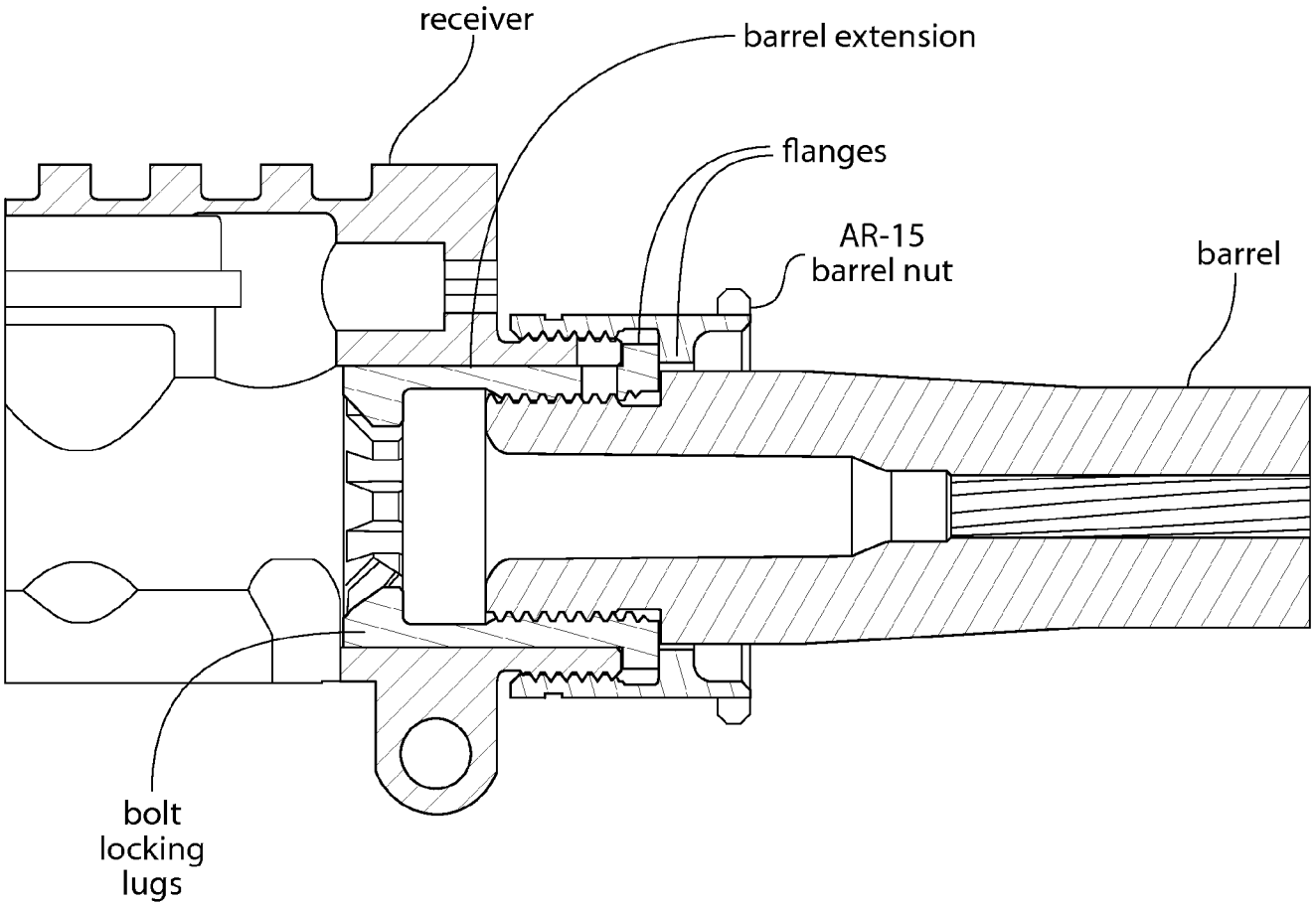
FIG. 2 (PRIOR ART)
FIG. 2 is a cross-sectional side view of the breech area of an AR-15 type rifle with slide-in barrel.
Figure 3:
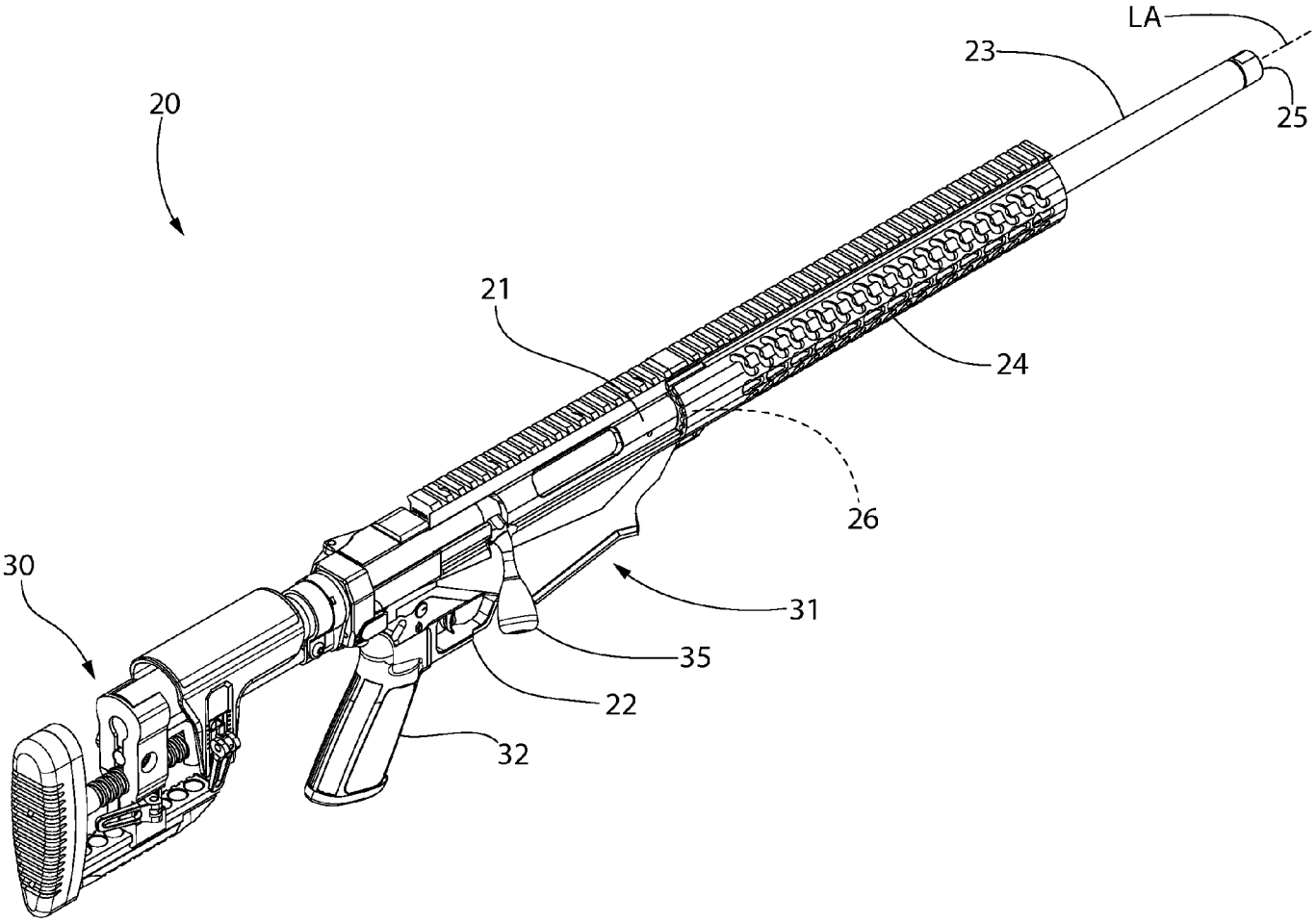
FIG. 3 is a longitudinal perspective view of one embodiment of a bolt action rifle including a barrel and handguard mounting system according to the present disclosure.
Figure 6:
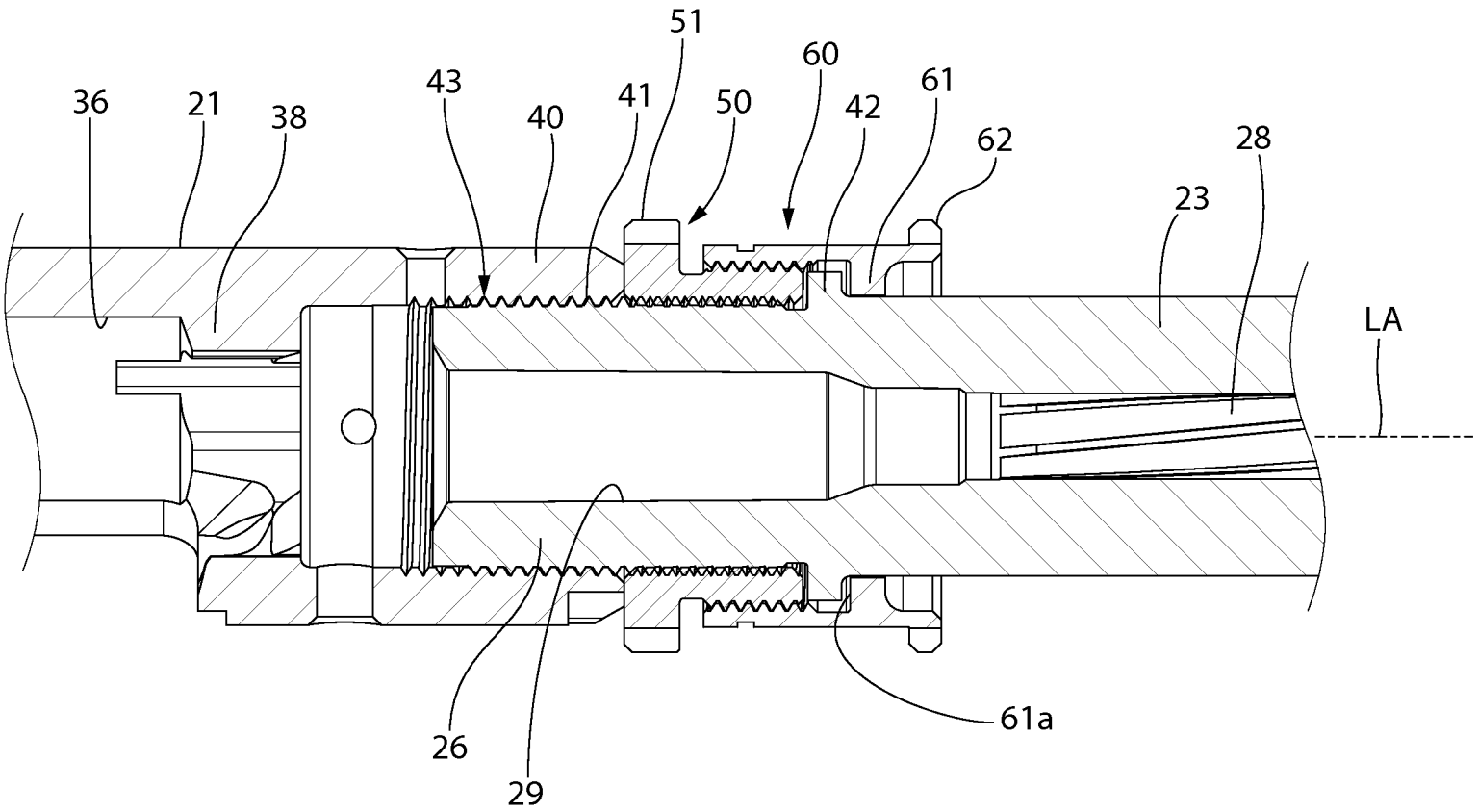
FIG. 6 is a side cross-sectional view thereof.

A plurality of inwardly and radially extending bolt locking lugs 38 are formed inside and proximate to the open front end 40 of the receiver 21 (see also FIG. 6). This contrasts to AR-15 type rifles in which the bolt locking lugs are instead formed outside the receiver on a barrel extension secured to the rear end of the barrel (see, e.g. FIG. 2). The lugs 38 are circumferentially spaced apart forming axial channels between the lugs which allow insertion therethrough of outwardly and radially extending bolt lugs 39 formed on the front end of the bolt 34 when the bolt is advanced forward by the user to close the breech. Once the bolt lugs 39 are positioned in front of the bolt locking lugs 38 when the breech is closed, the user rotates the bolt 34 in a known manner using the bolt handle 35 to lock the breech. The firearm 20 is now in a ready-to-fire condition with a chambered ammunition cartridge. Such a locking breech operation is well known in the art without further elaboration necessary.

According to one aspect of the invention, a handguard mounting system is provided that has a unique barrel connection to receiver interface which allows an AR-15 style free floating tubular handguard 24 to be easily mounted to the barrel of a bolt action rifle, in lieu of the receiver or chassis as in the past. The handguard mounting system further advantageously provides a dual locking feature for superior tightness. The mounting system will now be described.

Figure 5:
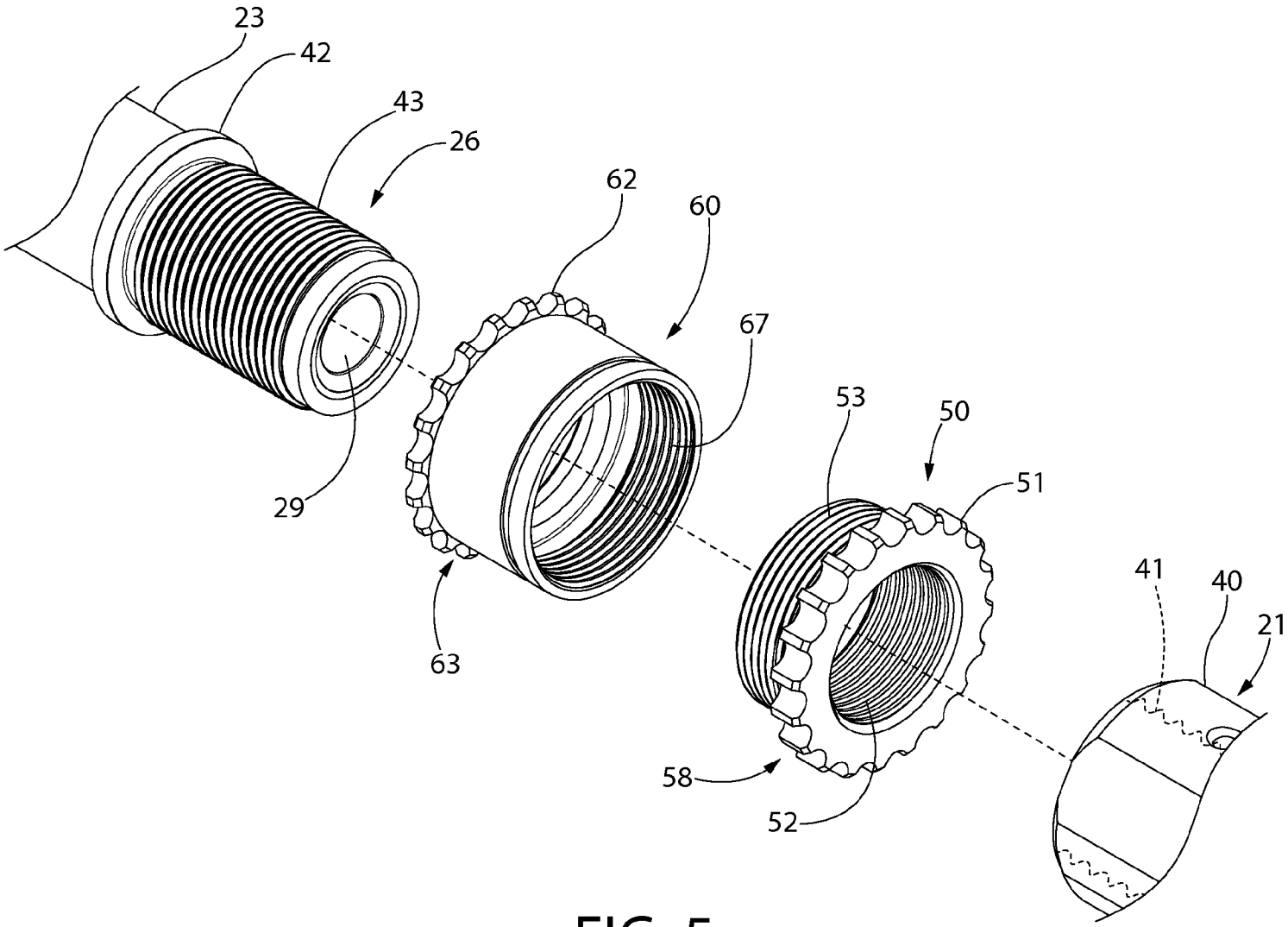
FIG. 5 is an exploded view of the barrel assembly of FIG. 3.

Referring initially to FIGS. 4-6, the handguard mounting system includes a barrel connection comprising two barrel nuts including a primary barrel nut 50 and a secondary barrel nut 60. The primary barrel nut and secondary barrel nut are concentrically aligned with longitudinal axis LA. In one embodiment, secondary barrel nut 60 may be an AR-15 barrel nut in configuration. The primary barrel nut 50 cooperates with the barrel 23 to form a first locking feature for coupling the barrel to the receiver 21. The secondary barrel nut 60 provides a second locking feature for coupling the barrel to the receiver 21, in addition to providing a mechanism for mounting an AR-15 style tubular handguard. The combination of the first and second locking features provided by the dual barrel nut assembly creates a tighter and more rigid barrel to receiver interface which surpasses both the conventional bolt action and AR-15 rifle type connections alone.

Figure 10A:
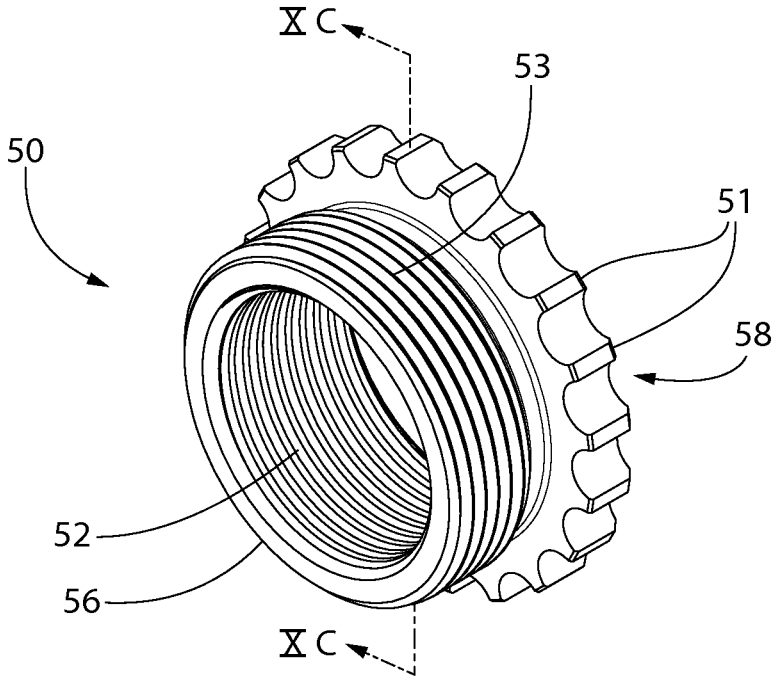
FIGS. 10A and 10B are rear and front perspective views of a primary barrel nut of the barrel assembly.
Figure 10B:
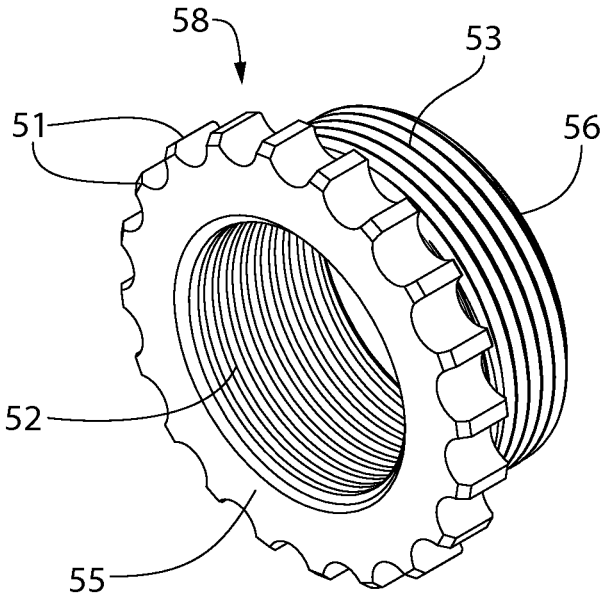
Figure 10C:
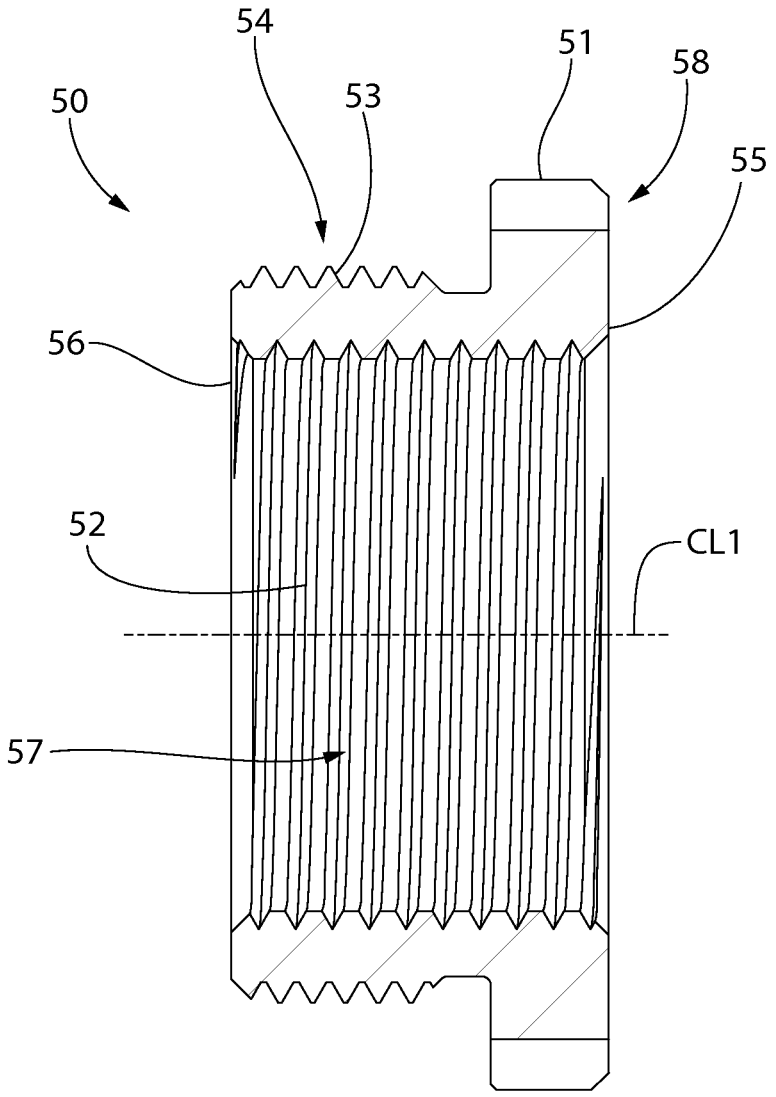
FIG. 10C is a side cross-sectional view thereof.

Referring to FIGS. 10A-C, primary barrel nut 50 has an open cylindrically shaped body including a front end 56, rear end 55, and a circumferentially extending sidewall 54 between the ends. The sidewall 54 has external threads 53 on an exterior surface and internal threads 52 on an interior surface formed in a through passage 57 extending between the ends along the axial centerline CL1 of the barrel nut. In one possible non-limiting implementation, an annular castellated sprocket 58 comprising a plurality of circumferentially spaced apart and radially extending protrusions or teeth 51 may be disposed on the outer surface of the sidewall 54. The sprocket 58 may generally have a scalloped shape with concave recesses formed between adjacent sprocket teeth 51 in one embodiment. The sprocket teeth 51 provide a hold for grasping either by hand and a barrel nut wrench to tighten the barrel nut 50 to a prescribed torque. In the illustrated embodiment, the castellated sprocket 58 is positioned at the rear end 55 of barrel nut 50; however, in other embodiments the sprocket may be axially positioned at other suitable locations so long as it does not interfere with mounting the secondary barrel nut 60. In other possible embodiments, the sprocket 58 may be omitted and other means may be used to tighten the primary barrel nut (e.g. hex shaped nut body).

Figure 11A:
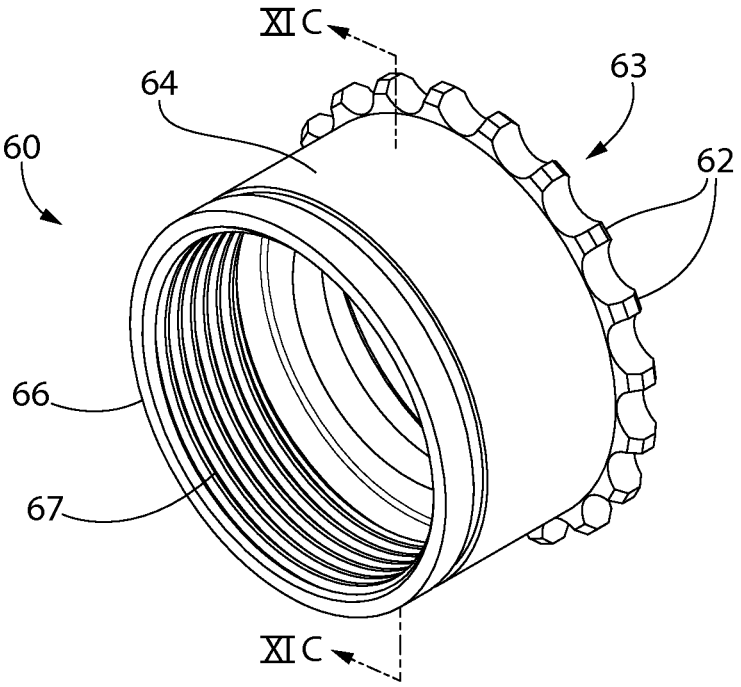
FIGS. 11A and 11B are rear and front perspective views of a secondary barrel nut of the barrel assembly.
Figure 11B:
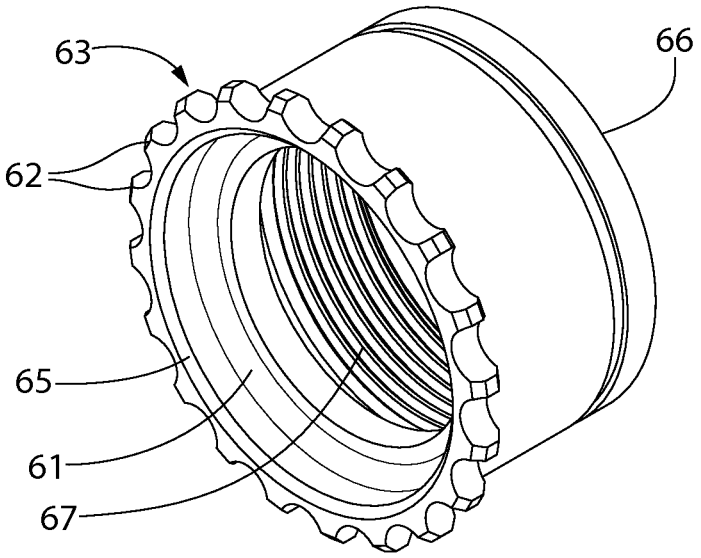
Figure 11C:
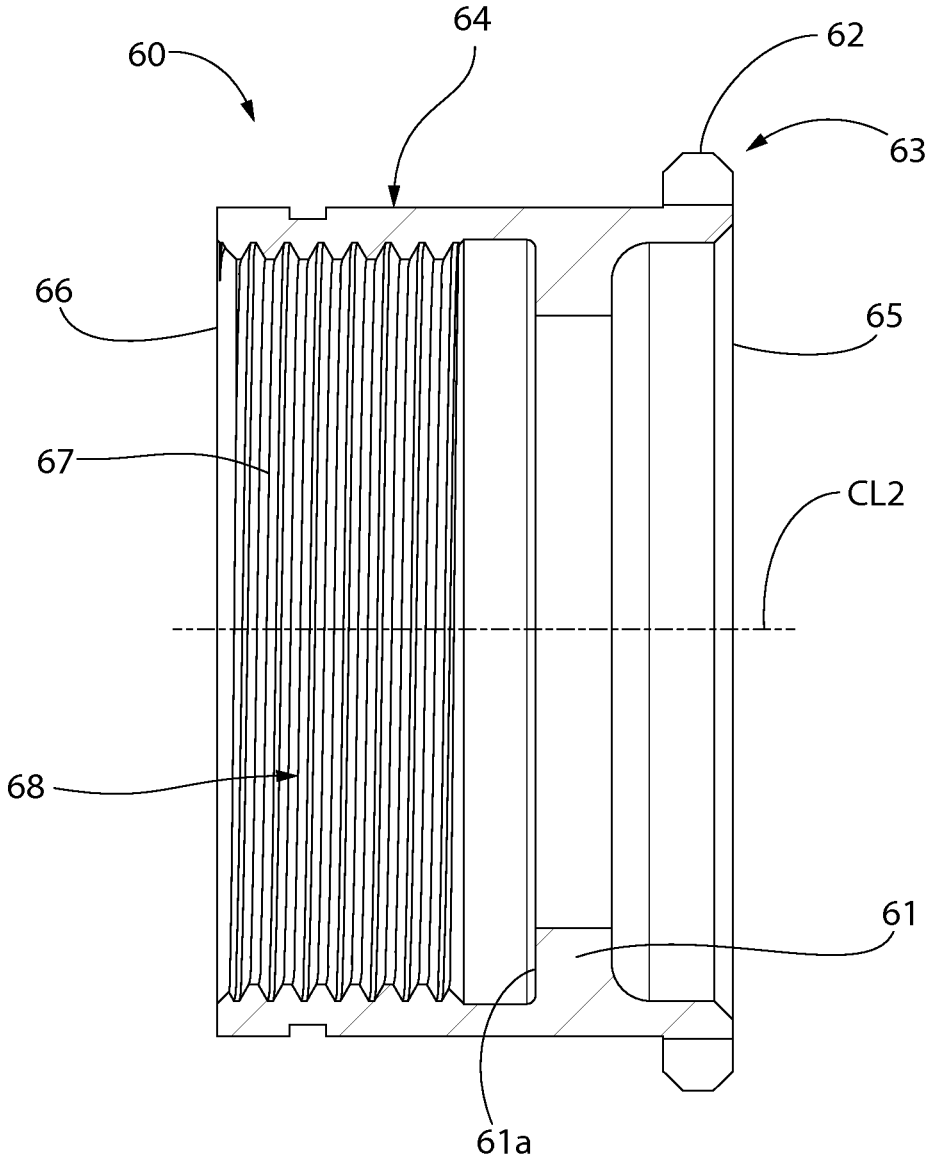
FIG. 11C is a side cross-sectional view thereof.
Figure 12:
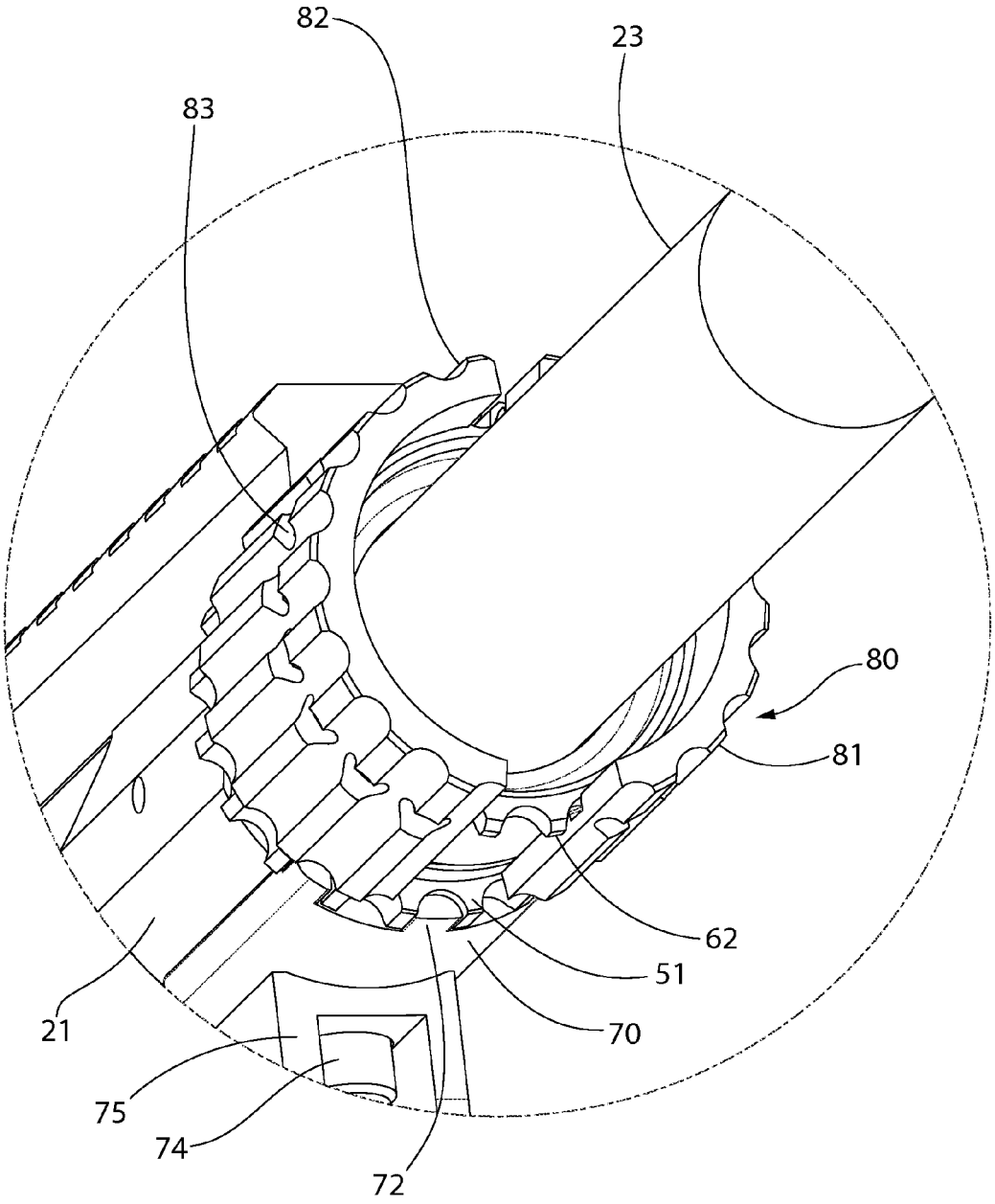
FIG. 12 is a front perspective view of a handguard nut attached to the secondary barrel nut of FIGS. 11A-C.
Figure 13:
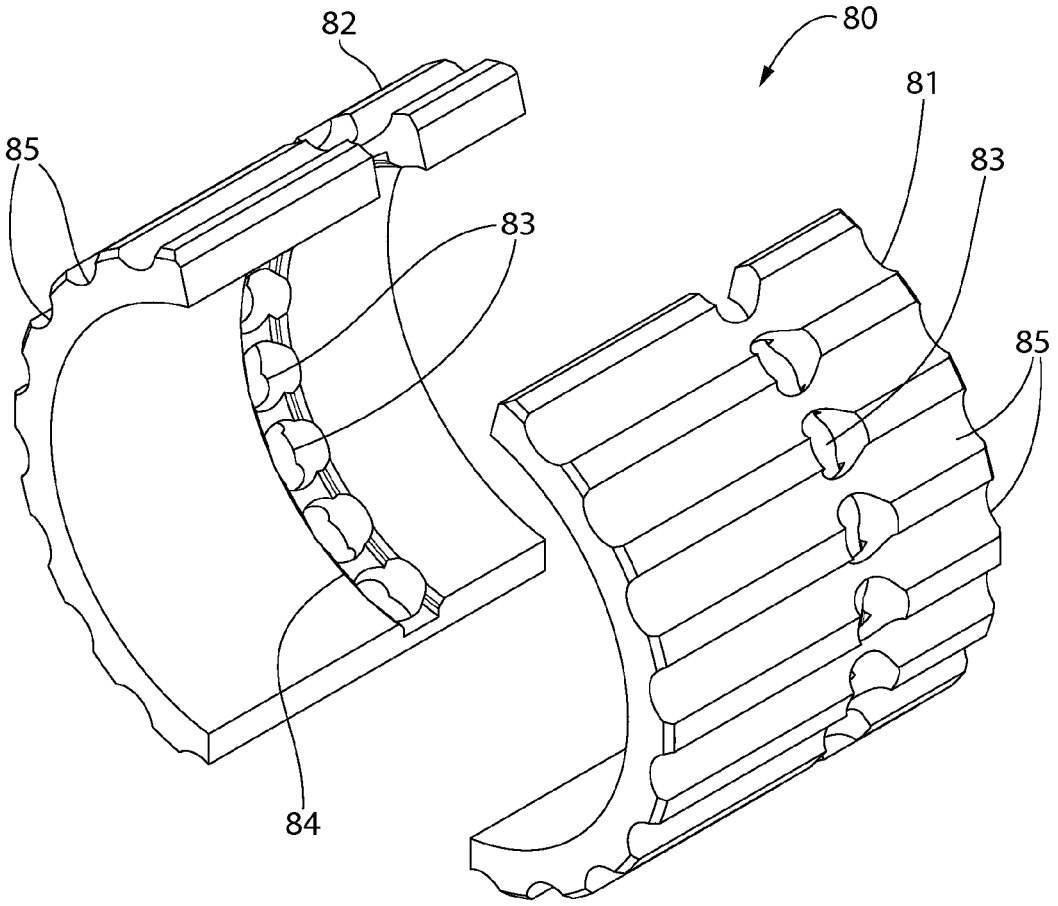
FIG. 13 is an exploded perspective view of the handguard nut.
Figure 14:
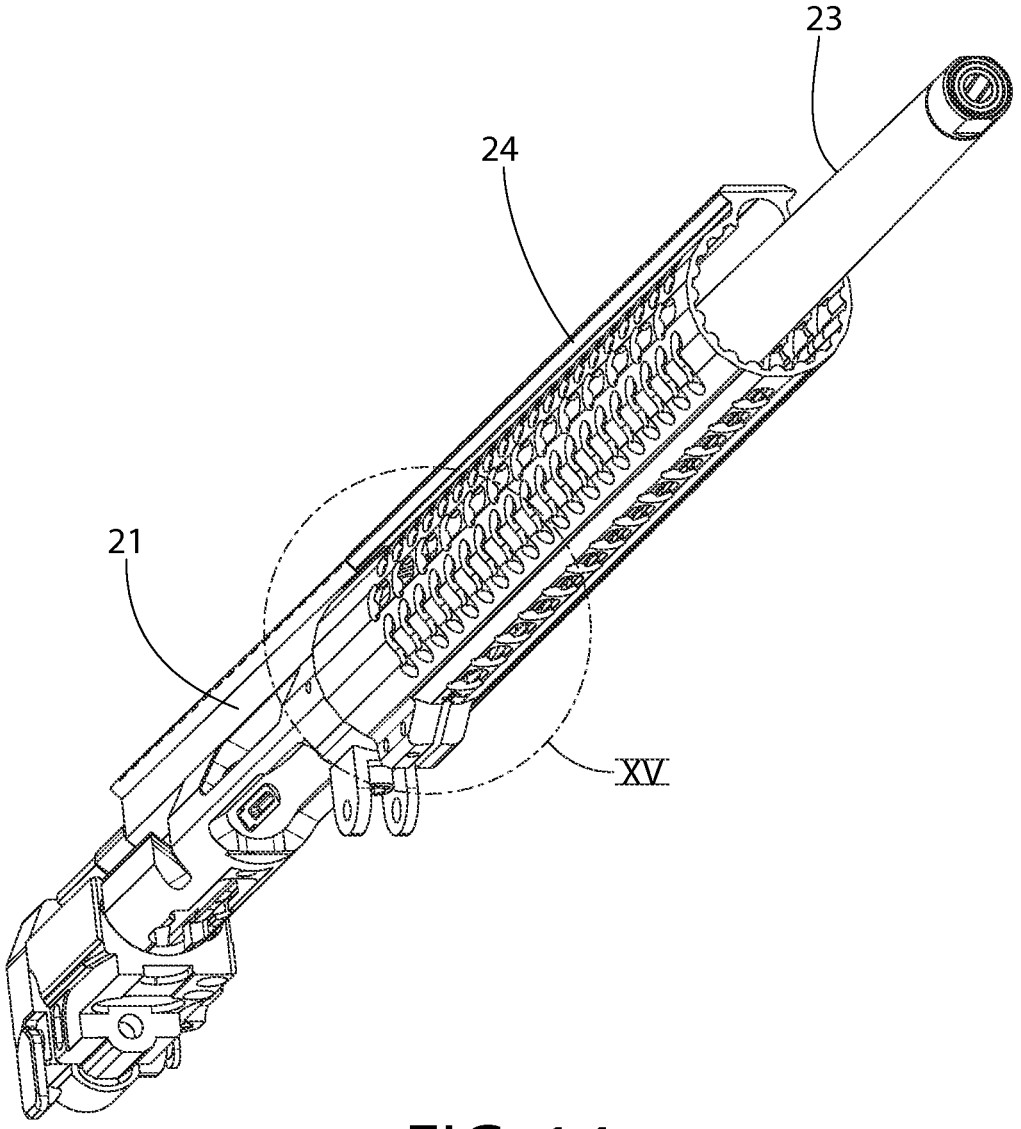
FIG. 14 is a front perspective view of the firearm with handguard attached.
Figure 15:
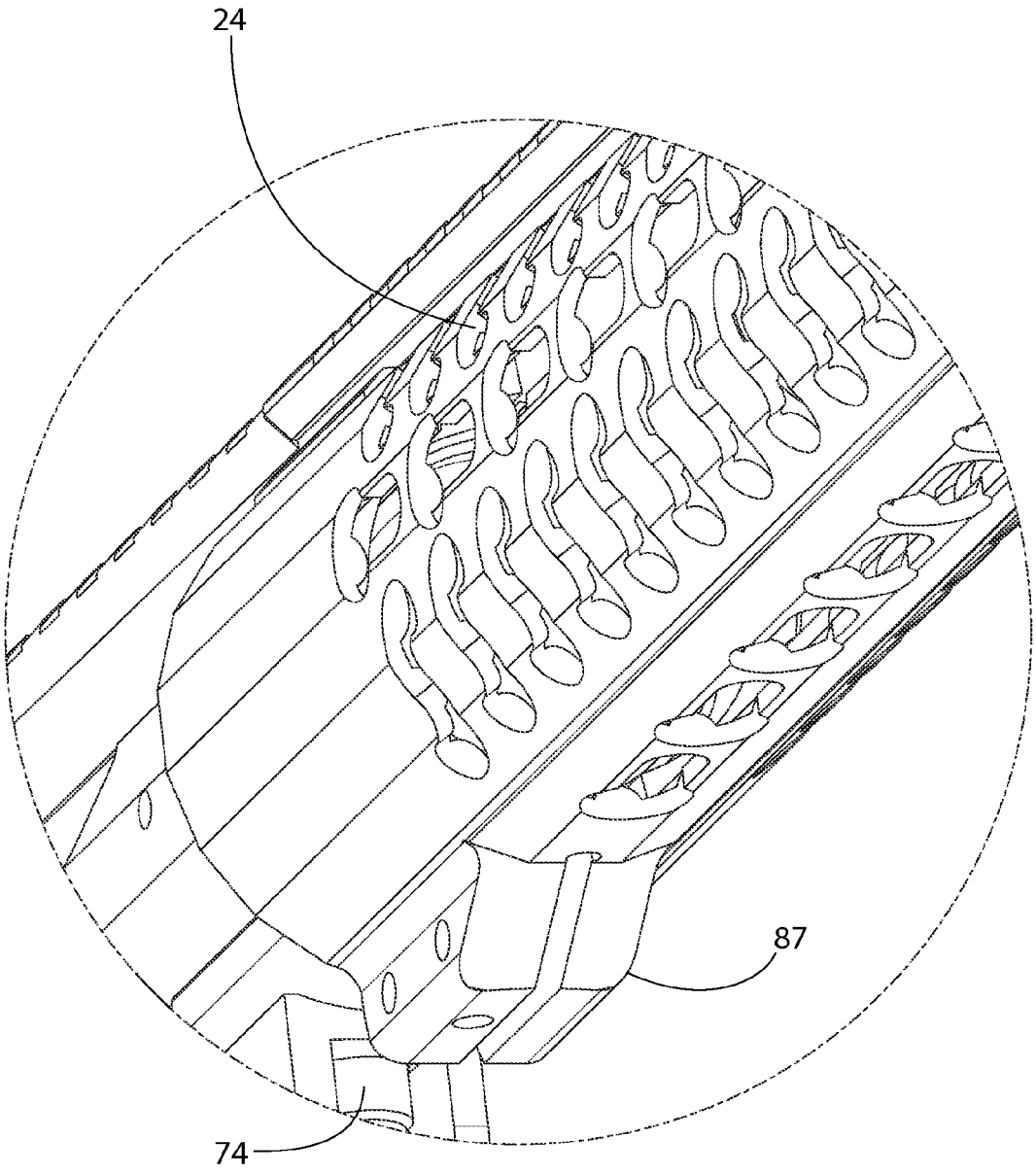
FIG. 15 is a perspective view detail taken from FIG. 14.
Figure 16:
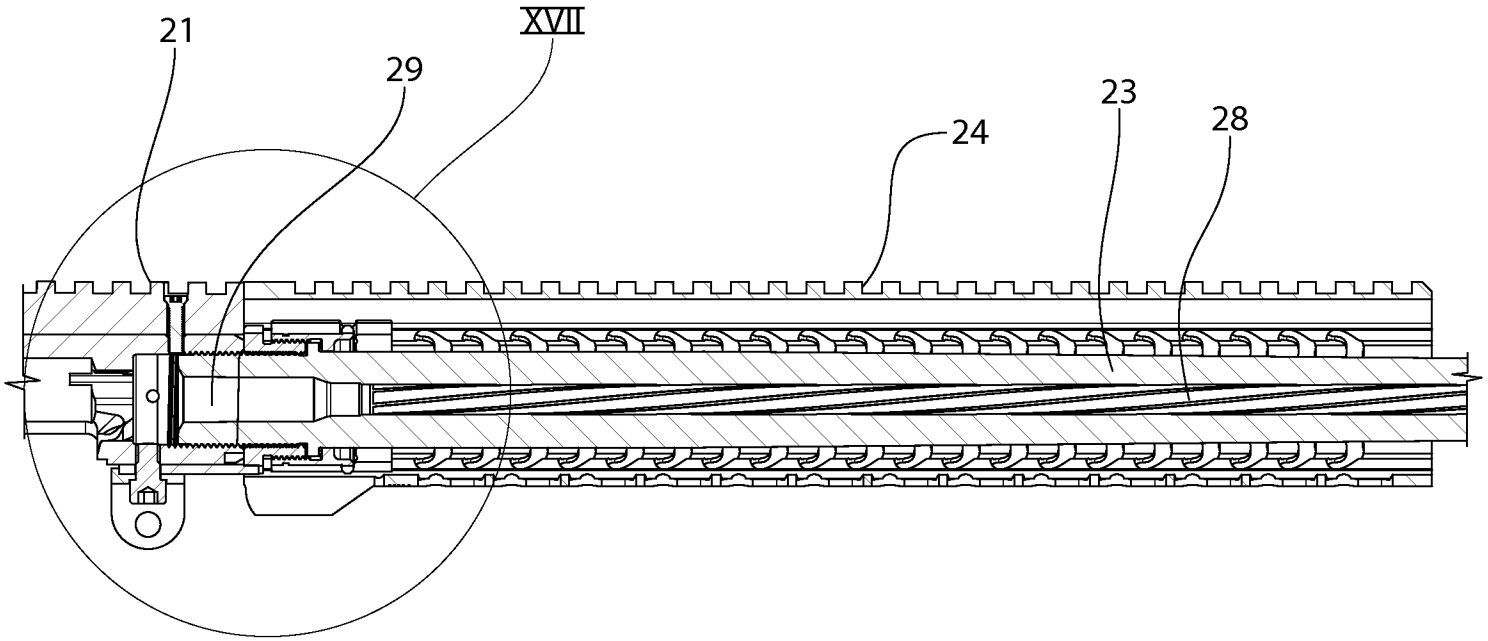
FIG. 16 is a partial longitudinal cross-sectional view of the firearm.
Figure 17:
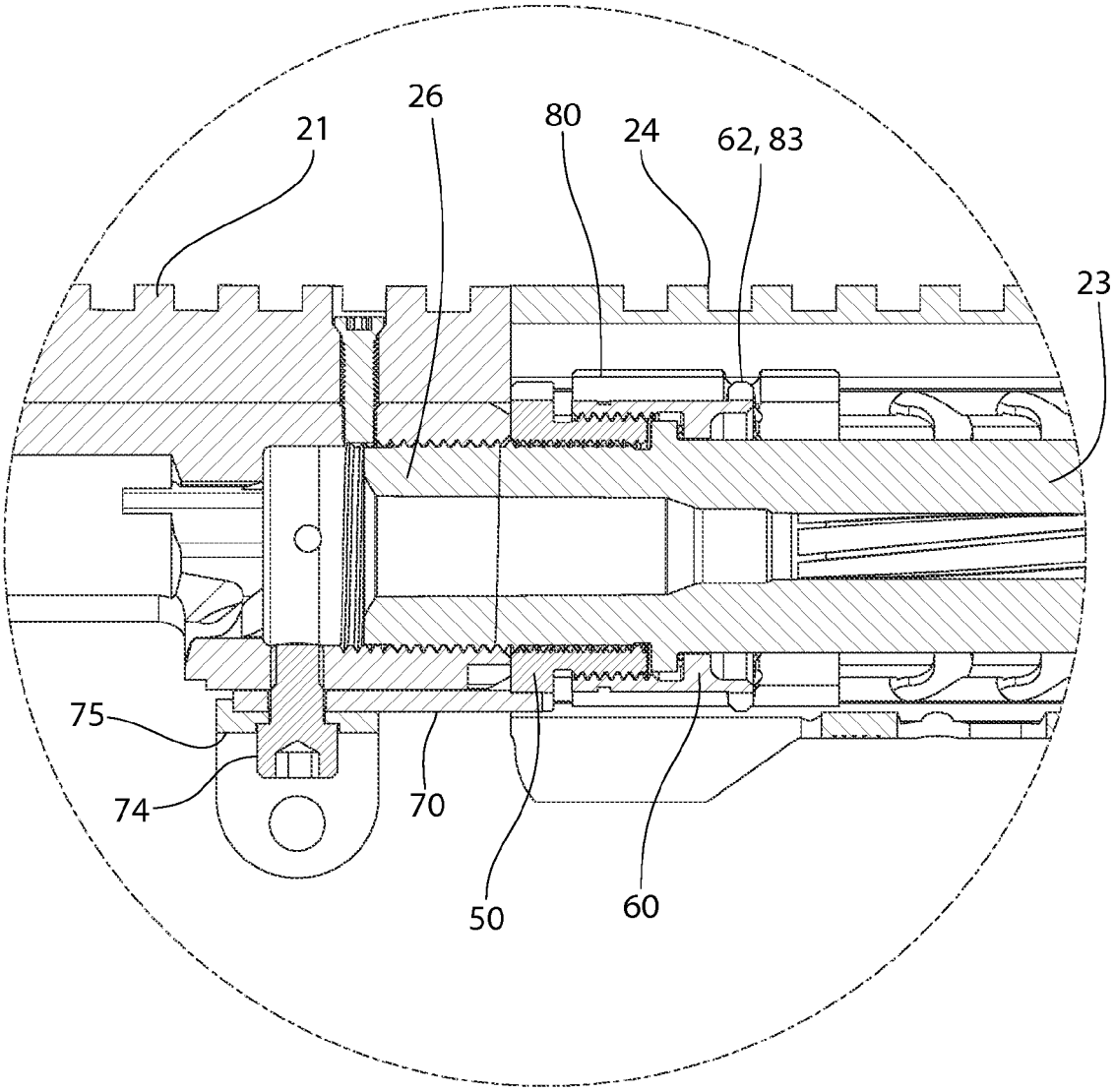
FIG. 17 is a cross-sectional detail taken from FIG. 16.
Figure 18:
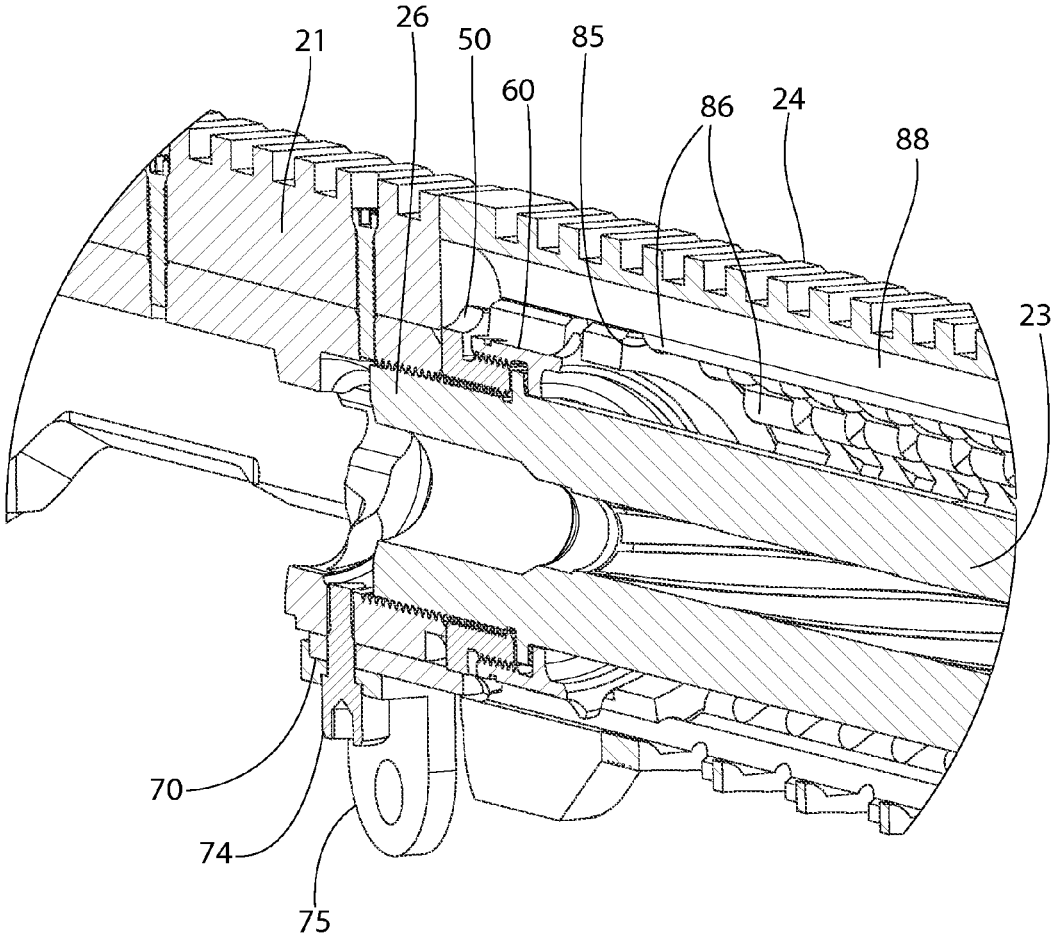
FIG. 18 is a perspective view thereof.

Referring to FIGS. 11A-C, secondary barrel nut 60 has an open cylindrically shaped body including a front end 65, rear end 66, and a circumferentially extending sidewall 64 between the ends. The sidewall 64 has internal threads 67 on an interior surface formed in a through passage 68 extending between the ends along the axial centerline CL2 of the barrel nut. In one possible non-limiting implementation, a castellated sprocket 63 comprising a plurality of circumferentially spaced apart and radially extending protrusions or teeth 62 may be disposed on the outer surface of the sidewall 64. The sprocket 63 may generally have a scalloped shape with concave recesses formed between adjacent sprocket teeth 62 in one embodiment. The sprocket teeth 62 provide a convenient hold for grasping either by hand and a barrel nut wrench to tighten the secondary barrel nut 60 to a prescribed torque. In addition, a tubular handguard having an interface which requires a sprocket for mounting may be mounted on the barrel 23 of firearm 20 using the sprocket 63 as further described herein. In the illustrated embodiment, the castellated sprocket 63 is positioned at the front end 65 of secondary barrel nut 60; however, in other embodiments the sprocket may be axially located at other suitable locations depending on the configuration of the handguard to be mounted thereto. The sprockets 58 and 63 may each be formed integrally as a unitary structural part of primary barrel nut and secondary barrel nut 50, 60, respectively, or may be separated elements mounted thereto by a suitable mechanical securement means such as without limitation welding, fasteners, adhesives, or other.

The secondary barrel nut 60 includes an internal annular abutment surface 61*a* formed in through passage 68 for abuttingly engaging an annular external flange 42 on the barrel 23, as further described herein. In one embodiment shown in FIG. 6, the abutment surface 61*a* may be formed on a fixed radially protruding annular internal flange 61 formed integrally with the body of secondary barrel nut 60 in through passage 68. Abutment surface 61*a* faces rearward when the secondary barrel nut is mounted to the firearm barrel 23.

Figure 19:
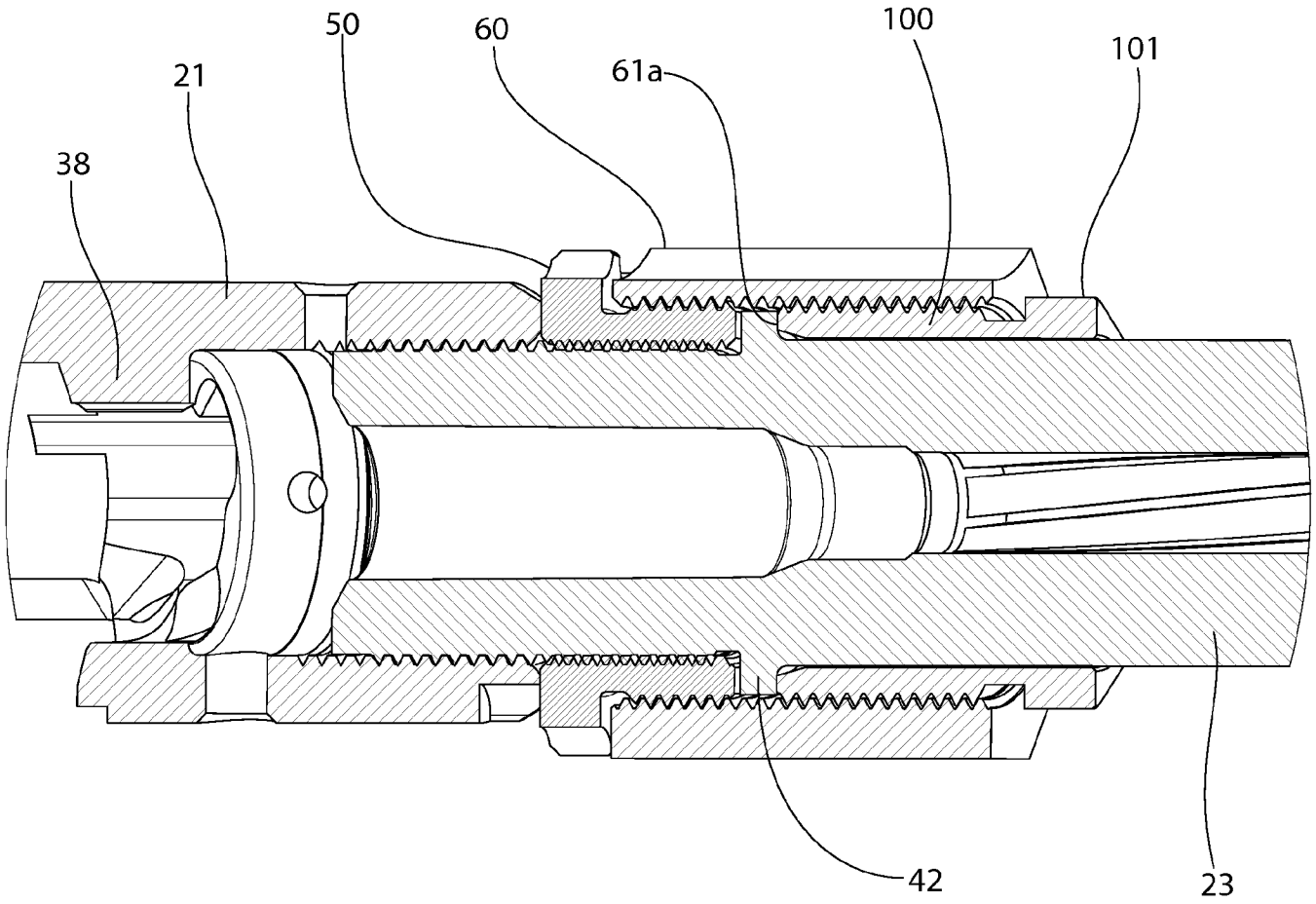
FIG. 19 is a side cross-sectional view of an alternative embodiment of a secondary barrel nut assembly having an adjustable internal annular abutment surface.

In an alternative embodiment shown in FIG. 19, the rear facing annular abutment surface 61*a* may instead be formed on the rear end of an externally threaded shoulder bushing 100 which engages the internal threads 67 of the secondary barrel nut 60. The threads 67 in this configuration extend all the way through the internal axial passage 68 of the barrel nut body from end to end without any interruption by a flange 61 as in the first embodiment which is omitted here. The bushing 100 forms an axially adjustable abutment surface 61*a* which is movable in position with respect to the main body of the secondary barrel nut 60. With this secondary barrel nut assembly, the main body of the barrel nut 60 is threaded onto the primary barrel nut 50 first. Then, the bushing 100 is threaded through the outer main body of the secondary barrel nut assembly until the abutment surface 61*a* abuttingly engages the external flange 42 of the primary barrel nut 50 as shown. Bushing 100 may have an enlarged head 101 configured to engage a tool such as without limitation a hex head in one non-limiting embodiment for using a wrench to tighten the bushing against the barrel external flange 42 to the prescribed torque. In this instance, the external sprocket 62 may be omitted as shown unless needed for mounting the handguard to the sprocket for the type of tubular handguard which requires the sprocket.

Referring back now to FIGS. 4-6, barrel 23 has a rear end 26 which may be slightly reduced in diameter (in contrast to forward portions of the barrel beyond the connection). The rear end 26 is externally threaded 43 and screws into a mating internally threaded bore 41 in the front end 40 of receiver 21. The threaded bore 41 is recessed into the main body of the receiver 21 at the front end 40 which has a generally flat forward face without any forwardly extending barrel mounting projections or nipples unlike an AR-15 type rifle (see, e.g. FIG. 2). When fully mounted in the receiver 21, a portion of the threads 43 on the rear end 26 remain exposed. This portion is engaged by the primary barrel nut 50 which is threaded onto the rear end 26 of the barrel. The primary barrel nut 50 is trapped between a radially protruding annular external flange 42 on the barrel 23 forward of the externally threaded rear end 26 of the barrel and the front end 40 of the receiver. The rear end of the primary barrel nut 50 abuts the front end of receiver 21 to provide a tight connection between the receiver and barrel 23, thereby forming the first locking feature.

The secondary barrel nut 60 is threaded onto the external threads 53 of the primary barrel nut 50. The internal annular abutment surface 61*a* (whether formed the internal flange 61 of the secondary barrel nut assembly or the positionable bushing 100) abuttingly engages the external flange 42 of the barrel 23 in one embodiment. The abutment surface 61*a* traps the barrel flange 42 between the primary barrel nut 50 and secondary barrel nut 60 to further secure the barrel to receiver connection, thereby forming the second locking feature. This helps ensure that the primary barrel nut 50 does not loosen and rotate forward on the barrel over time from firing the firearm 20 which might in turn loosen the direct barrel to receiver threaded connection.

A method for mounting a screw-in type bolt action rifle barrel to the firearm 20 will now be described. Referring generally to FIGS. 4-6, the receiver 21 with internally threaded bore 41 that opens forward is provided. The primary barrel nut 50 is preferably first threaded directly onto the rear end 26 of the barrel 23. Because in the present embodiment the primary barrel nut 50 has an inside diameter (defined by sidewall 54) which is smaller than the outside diameter of the barrel flange 42, it is not possible to mount the primary barrel nut 50 after the barrel 23 is mounted on the receiver 21 due to interference between barrel flange and primary barrel nut sidewall.

The barrel 23 is next rotated and screwed or threaded into threaded bore 41 of the receiver 21. The axial position and insertion depth of the barrel in the bore may be adjusted to set the proper headspace. Once the headspace is set, the primary barrel nut 50 is then advanced rearward by hand initially and then tightened to the prescribed torque range with assistance of a tool such as a barrel nut wrench (which is well known in the art), thereby ensuring a sufficiently tight connection between the barrel 23 and receiver 21. The barrel nut wrench may use the castellated sprocket 50 for tightening the primary barrel nut 50 and connection. In one embodiment, the connection may be tightened to a torque range of about and including 90 to 150 ft.-lbs. (foot pounds). Advantageously, this forms a tighter connection than AR-15 style barrel nuts which are torqued to only 35 to 80 ft.-lbs. typically.

The secondary barrel nut 60 is then slipped over the muzzle end 25 of the barrel 23 and slide rearward until the primary barrel nut 50 is contacted. The secondary barrel nut 60 is then rotated to engage the internal threads 67 of the secondary barrel nut with the external threads 53 on the primary barrel nut 50. The secondary barrel nut 60 is thus threadably mounted directly to the primary barrel nut 50, and has no other tightenable type connection to either the barrel or the receiver. The secondary barrel nut 60 is advanced rearward by continued rotation of the barrel nut until the internal abutment surface 61*a* engages the external flange 42 of the barrel 23. The secondary barrel nut 60 may be tightened to the prescribed torque range also using a barrel nut wrench and the castellated sprocket 62. The torque range in one embodiment may be about and including 35 to 80 ft.-lbs. The barrel 23 is now securely mounted to the receiver 21 by virtue of the dual locking features provided by the primary and secondary barrel nuts 50, 60.

It should be noted that many AR-15 handguards have different types of barrel nuts, but they still use the same thread size and contact the barrel flange (typically provided on the barrel extension) in the same location. Accordingly, the barrel connection arrangement disclosed herein with respect to the barrel flange threading provided on the primary barrel nut 50 provides essentially the same consistent dimensions and interface for accepting the secondary barrel nut 60 which may be an AR-15 barrel nut. In addition to supporting an AR-15 tubular handguard, the dimensions of the present barrel connection mounting components may be scaled up and designed for use with AR-10 or SR-25 type rifles. This larger version interfaces the same way, but allows for a larger barrel diameter to support larger cartridges.

There are other alternative but less preferred ways to attach an AR-15 handguard to a bolt action rifle 20 by modifying the barrel connection arrangement described herein. For example, the external flange 42 could be removed from the barrel 23 and the AR-15 type secondary barrel nut 60 could be made to bottom out on a standard bolt action rifle barrel nut (shown in FIG. 1) by adding external threads to the barrel nut as disclosed herein.

The barrel connection configuration described above is desired because it provides benefits beyond just attaching handguards to the firearm. While the primary barrel nut 50 acts as a jam-nut to secure the barrel 23 to the receiver 21, the actual contact between the barrel nut, barrel, and receiver may not be as stable as it could be. When placing threaded connections in tension, it has been found that most of the load is carried but the first three to four threads due to normal deformation of the threads. This implies that all of the threaded surfaces are not actually providing significant support to maintain consistent barrel alignment. By adding a secondary barrel nut 60 or barrel nut assembly that contacts both the barrel 23 and the primary barrel nut 50, additional threaded surfaces are brought into contact, advantageously further stabilizing the barrel to receiver connection. The external flange 42 on the barrel 23 creates a better contact surface for engagement with the secondary barrel nut 60 than just the angled threaded surfaces and increases the surface area in contact. All of this contributes to a more securely tightened barrel to receiver connection.

Because the handguard 24 is secured to the barrel 23 and barrel nut assembly disclosed herein, it is possible that a torque load could be applied to the primary barrel nut 50 either during normal use of the firearm, or during removal and installation of the handguard. To ensure that the primary barrel nut 50 is not inadvertently moved and untightened (which may also adversely affect the headspace), a locking or anti-rotation feature is desirable.

Figure 7:
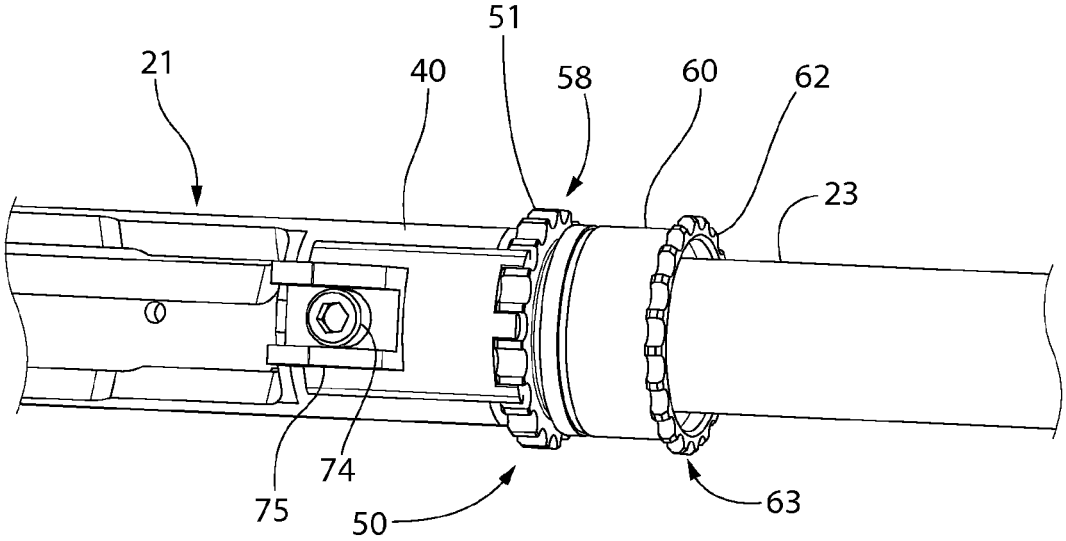
FIG. 7 is a bottom view of the front end of the receiver showing a locking or anti-rotation feature.
Figure 8:
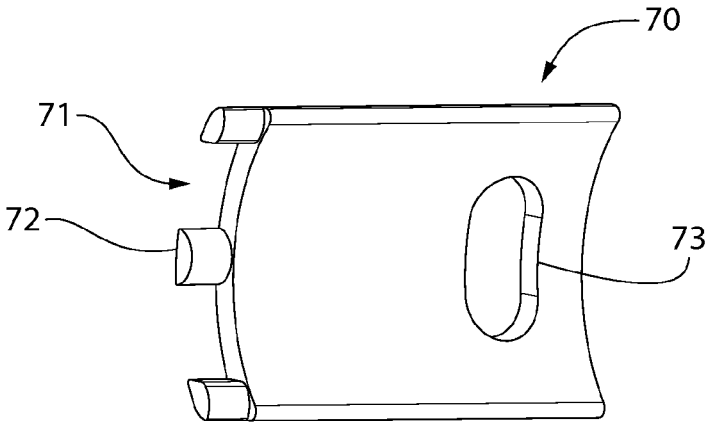
FIG. 8 is a perspective view of an anti-rotation clamp thereof.
Figure 9:
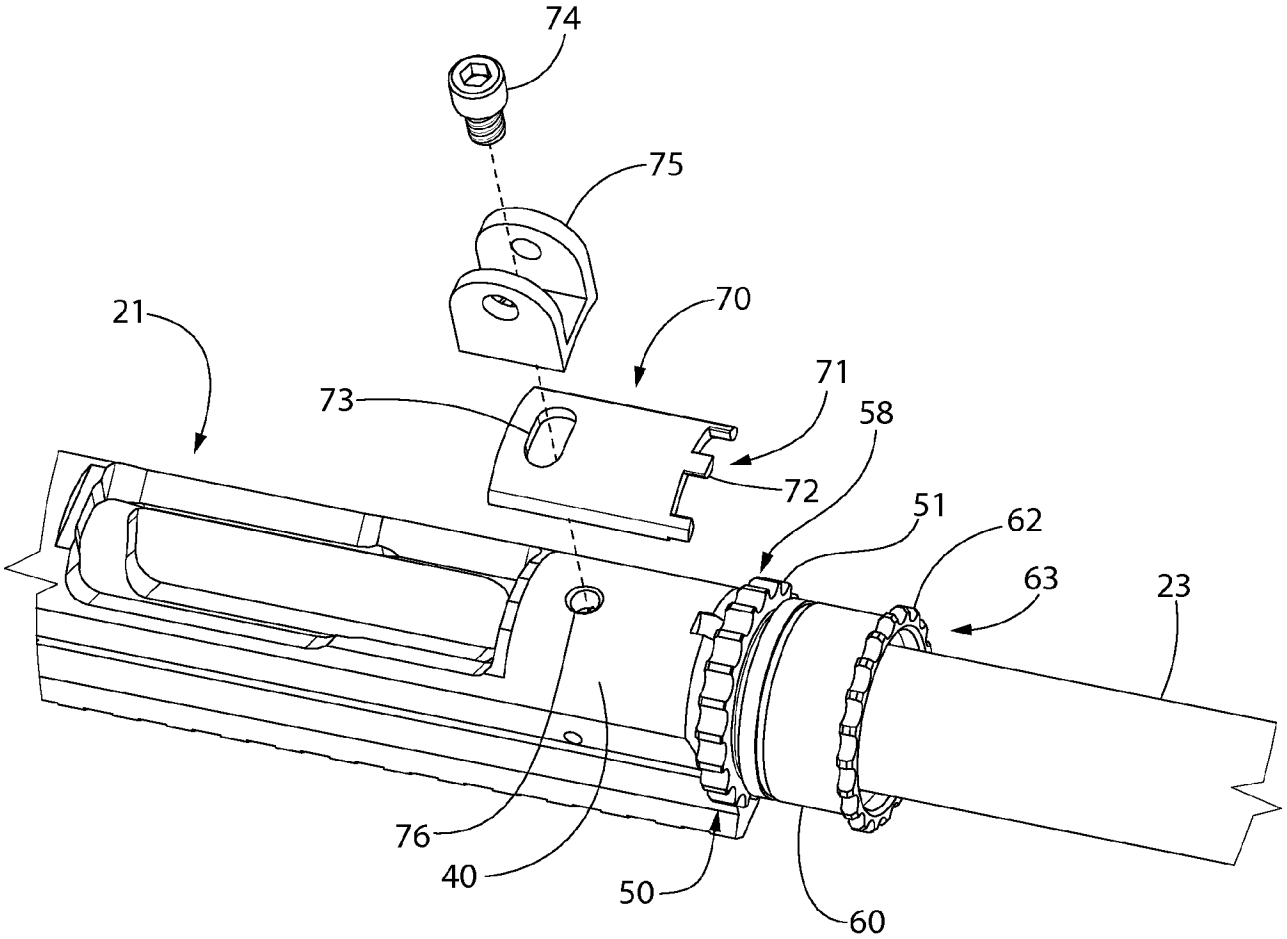
FIG. 9 is an exploded view of the components of FIG. 7.

FIGS. 7-9 show one embodiment of a locking or anti-rotation element that allows the primary barrel nut 50 to be installed to a given torque value without concern for precise timing (i.e. circumferential locations) of the sprocket protrusions 62 features. The anti-rotation element generally comprises a removable anti-rotation clamp 70 configured to engage the sprocket teeth 51 of the primary barrel nut 50 after which the clamp is locked to the receiver 21. Clamp 70 may be formed of an arcuately curved plate having a complementary radius to the outer radius of the portion of the front 40 of the receiver to which the clamp is mounted. Other configurations are possible including flat depending on the profile of the receiver. In one embodiment, the clamp 70 is mounted to the underside of the receiver 21 proximate to the primary barrel nut 50. The clamp 70 has a front castellated end 71 comprising a plurality of spaced apart and forwardly extending locking protrusions 72 configured to engage the castellated sprocket 58 between the sprocket teeth 51 of the primary barrel nut 50.

The anti-rotation clamp 70 may be secured and locked in place on the receiver 21 with a threaded fastener 74 in one embodiment which engages a threaded hole 76 on the underside of the receiver. To provide variable circumferential positioning and adjustment for aligning the locking protrusions 72 with the sprocket teeth 62, an elongated adjustment slot 73 is provided in the clamp 70 which receives the fastener 74 therethrough. The slot 73 is oriented transversely to the longitudinal axis of the firearm 20 which permits a limited range of circumferential adjustment, but maintains the axial position of the clamp 70 with respect to the sprocket teeth 62.

In use after the barrel 23 has been fully mounted to the receiver 21 using the primary barrel nut 50 and torqued to the required range, the anti-rotation clamp 70 is then placed against the receiver 21 with the locking protrusions 72 falling between the sprocket teeth 51 of the primary barrel nut 50 while ensuring that the adjustment slot 73 is aligned with the threaded hole 76 in the underside of the receiver. The fastener 74 may then be inserted through the slot, and threadably engaged with the receiver and tightened to secure the clamp. The head of the fastener 74 is larger than the slot so that the head traps the clamp between the fastener and receiver 21. The secondary barrel nut 60 is next preferably mounted on the barrel 23 with the anti-rotation clamp 70 already mounted so that tightening the secondary barrel nut may not inadvertently loosen the primary barrel nut 50 connection.

In some embodiments, other appurtenances such as a clevis 75 used to connect the chassis 31 or lower receiver containing the fire control mechanism 22 to the receiver 21 may conveniently be mounted to the receiver using the same fastener 74. In this case, the clevis 75 is trapped between the head of the fastener and the clamp 70. The clevis however is not a necessary part of the locking or anti-rotation element, and is merely disclosed to illustrate efficient use of the anti-rotation clamp for additional purposes to conserve space.

Other less easily removable locking or anti-rotation methods could also be used to prevent the barrel to receiver connection from loosening such as without limitation staking processes, pinning, or adhesives. The removable locking clamp 70 is preferred in one embodiment because it allows easy disassembly of the barrel connection components for removing the barrel from the firearm.

The standard method for attaching one particular type of a standard AR-15 style free floating tubular handguard such as handguard 24 to the barrel nut assembly will now be briefly described for completeness without significant detail. This type of handguard presently to be describes requires a sprocket for mounting; however, other AR-15 style handguards utilize other mounting methods besides a sprocket. Such a handguard attachment method for AR-15 type rifles is well known in the art without undue elaboration here.

Referring to FIG. 12-18, a split handguard nut 80 comprising two arcuate halves 81, 82 is first installed around the secondary barrel nut 60. A plurality of circumferentially spaced apart apertures 83 in each half engages one of the sprocket teeth 62 of the secondary barrel nut. The apertures 83 may be formed in a circumferential groove 84 on an interior surface of the handguard nut 80. The exterior surface of the handguard nut 80 is configured to engage mating interior surface securement features of the handguard 24. In one embodiment, the handguard nut 80 may comprise a plurality of circumferentially spaced apart axial channels 85 which engage mating axial protrusions on the inside of the handguard 24 (shown in FIG. 18). The handguard 24 has a tightening clamp 87 at its rear end which allows threaded fasteners to be inserted therethrough and tightened to secure the handguard to the secondary barrel nut 60 after the handguard is positioned over the handguard nut 80. The handguard 24 is fully supported by the secondary barrel nut 60 in a cantilevered manner. The handguard 24 surrounds the barrel 23 for at least part of the length of the barrel and an annular gap 88 is formed between the inner surface of the handguard and barrel thereby defining a free-floating handguard assembly. The rear end of the handguard 24 may abut the front of the receiver 21 but is not otherwise connected to or supported by the receiver in one embodiment.

In all cases of the present dual barrel nut arrangement disclosed herein, the secondary barrel nut or barrel nut assembly preferably provides the means for mounting the free float tubular handguard. The sprocket teeth disclosed herein is just one example of many different means used to mount tubular handguards to rifles. Other designs use tapped holes in a single AR-15 style barrel nut to accept fasteners for mounting the handguard to the barrel nut. Still others clamp the handguard onto a cylindrical single barrel nut with no sprocket teeth. The threads on the primary barrel nut and the barrel flange disclosed herein reproduce the geometry common with an AR-15 upper to facilitate use of these many possible free float handguard mounting options. Preferably, the secondary barrel nut or barrel nut assembly includes an abutment surface for engaging the barrel flange to provide the dual barrel locking feature arrangement.

The primary barrel nut and secondary barrel nut 50, 60 may be made of a suitable material including preferably metals (e.g. aluminum, steel, titanium, etc.) or non-metals (e.g. glass reinforced or unreinforced polymers, etc.). The receiver 21 and barrel 23 are preferably made of metal. Locking clamp 70 may be made of a suitable material including metals (e.g. aluminum, steel, titanium, etc.) or non-metals (e.g. glass reinforced or unreinforced polymers, etc.).

While the foregoing description and drawings represent exemplary embodiments of the present disclosure, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes described herein may be made within the scope of the present disclosure. One skilled in the art will further appreciate that the embodiments may be used with many modifications of structure, arrangement, proportions, sizes, materials, and components and otherwise, used in the practice of the disclosure, which are particularly adapted to specific environments and operative requirements without departing from the principles described herein. The presently disclosed embodiments are therefore to be considered in all respects as illustrative and not restrictive. The appended claims should be construed broadly, to include other variants and embodiments of the disclosure, which may be made by those skilled in the art without departing from the scope and range of equivalents.

What is claimed is:

1. A firearm with tubular handguard mounting system comprising:

a receiver;

a barrel supported by the receiver, the barrel comprising a muzzle end and a breech end threadably engaging a threaded bore in a front end of the receiver;

a primary barrel nut threadably engaging the breech end of the barrel, the primary barrel nut abuttingly engaging the front end of the receiver;

a secondary barrel nut assembly threadably engaging the primary barrel nut, the secondary barrel nut assembly including an annular abutment surface abuttingly engaging an external annular flange on the barrel, the external annular flange on the barrel compressed against the primary barrel nut by the annular abutment surface on the secondary barrel nut assembly; and a tubular handguard mounted to the secondary barrel nut assembly and encircling at least part of a length of the barrel.

2. The firearm according to claim 1, wherein the handguard is only supported by the secondary barrel nut at the breech end of the barrel.

3. The firearm according to claim 1, further comprising a sprocket disposed on the primary barrel nut comprising a plurality of radially extending sprocket teeth projecting outwards from the primary barrel nut.

4. The firearm according to claim 3, further comprising an anti-rotation element attached to the receiver and having a front end engaging the sprocket on the primary barrel nut, the anti-rotation element meshed with the sprocket and preventing the primary barrel nut from rotating.

5. The firearm according to claim 4, wherein the anti-rotation element comprises an arcuate plate having a front end with forwardly extending locking protrusions which engage the primary barrel nut between the sprocket teeth.

6. The firearm according to claim 4, wherein the anti-rotation element is attached to the receiver with a fastener received through an elongated slot formed in the anti-rotation element configured to allow adjustment of the anti-rotation element with respect to the sprocket on the primary barrel nut.

7. The firearm according to claim 1, wherein the abutment surface is formed by an internal annular flange in the secondary barrel nut assembly.

8. The firearm according to claim 1, wherein the abutment surface is formed by an axially adjustable bushing threadably engaged with internal threads formed on the secondary barrel nut assembly, the bushing being movable in forward and rearward axial directions with respect to the secondary barrel nut assembly for tightening the abutment surface against the external flange of the primary barrel nut.

9. The firearm according to claim 1, wherein the primary barrel nut and secondary barrel nut have a cylindrical shape each defining a through passage which receives the barrel therethrough.

10. The firearm according to claim 1, further comprising a sprocket disposed on the secondary barrel nut assembly comprising a plurality of radially extending sprocket teeth projecting outwards from the secondary barrel nut.

11. The firearm according to claim 10, further comprising a handguard nut comprising a plurality of apertures which engage the sprocket teeth of the secondary barrel nut assembly.

12. The firearm according to claim 11, wherein the handguard nut comprises a plurality of circumferentially spaced apart axial channels which engage mating axial protrusions on an inside surface of the handguard for mounting the handguard to the handguard nut.

13. The firearm according to claim 12, wherein the handguard includes a tightening clamp at a rear end thereof which receives threaded fasteners that are tightened to secure the handguard to the secondary barrel nut.

14. A firearm with tubular handguard mounting system comprising:

a receiver having a plurality of bolt locking lugs for forming a locked breech;

a barrel supported by the receiver, the barrel comprising a front muzzle end and a rear breech end having external threads, a first portion of the external threads threadably engaging a threaded bore in a front end of the receiver, and a second portion of the external threads positioned forward of the receiver;

a primary barrel nut threadably engaging the second portion of the external threads of the barrel on the breech end, the primary barrel nut further including external threads;

a secondary barrel nut threadably engaging the primary barrel nut, the secondary barrel nut including an internal annular abutment surface abuttingly engaging an external annular flange on the barrel, the external annular flange on the barrel compressed against the primary barrel nut by the annular abutment surface on the secondary barrel nut;

a sprocket formed on the primary barrel nut comprising a plurality of radially extending sprocket teeth projecting outwards from the primary barrel nut; and a tubular handguard coupled to the secondary barrel nut assembly and encircling at least part of a length of the barrel.

15. The firearm according to claim 14, wherein the handguard is only supported by the secondary barrel nut at the breech end of the barrel.

16. The firearm according to claim 14, further comprising a sprocket formed on the secondary barrel nut comprising a plurality of radially extending sprocket teeth projecting outwards from the secondary barrel nut, wherein the handguard is coupled to the sprocket on the secondary barrel nut by a handguard nut.

17. The firearm according to claim 14, wherein the abutment surface is formed by an internal annular flange in the secondary barrel nut.

18. The firearm according to claim 14, wherein the abutment surface is formed by an axially adjustable bushing threadably engaged with internal threads formed on the secondary barrel nut, the bushing being movable in forward and rearward axial directions with respect to the secondary barrel nut assembly for tightening the abutment surface against the external flange of the primary barrel nut.

19. The firearm according to claim 14, further comprising an arcuately shaped anti-rotation element attached to the receiver and having a front end engaging the sprocket on the primary barrel nut, the anti-rotation element meshed with the sprocket and preventing the primary barrel nut from rotating.

20. A method for mounting a tubular handguard on a firearm, the method comprising:

threading a primary barrel nut onto an externally threaded breech end of a barrel defining a chamber for holding a cartridge;

screwing the threaded breech end of the barrel into a threaded bore of a receiver;

rotating and tightening the primary barrel nut against the receiver to lock the barrel to the receiver;

sliding a secondary barrel nut over the barrel;

threading the secondary barrel nut onto the primary barrel nut by engaging internal threads of the secondary barrel nut with external threads on the primary barrel nut;

engaging an internal annular abutment surface on the secondary barrel nut with an external annular flange on the barrel;

rotating and tightening the secondary barrel nut to compress the external flange on the barrel against the primary barrel nut; and mounting a tubular handguard to the secondary barrel nut.

21. The method according to claim 20, wherein the primary barrel nut includes an annular shaped sprocket comprising a plurality of radially extending sprocket teeth.

22. The method according to claim 21, further comprising before the step of sliding the secondary barrel nut over the barrel and after the step of rotating and tightening the primary barrel nut, steps of:

engaging a plurality of locking protrusions on an anti-rotation element with the sprocket teeth on the primary barrel nut; and securing the anti-rotation element to the receiver to prevent the primary barrel nut from rotating.

* * * * *